US005178067A

United States Patent [19]

Collier

[11] Patent Number: 5,178,067

[45] Date of Patent: Jan. 12, 1993

[54] SPECIAL EFFECTS RUBBER STAMP

[76] Inventor: Harry B. Collier, 1356 E. Goldsmith Dr., Colorado, Colo. 80126

[21] Appl. No.: 701,486

[22] Filed: May 16, 1991

[51] Int. Cl.[5] ..... B41K 1/56

[52] U.S. Cl. ..... 101/405; 101/372; 101/368; 101/406; 40/455

[58] Field of Search ..... 101/405, 406, 494, 368, 101/372; 446/404, 81, 397, 303, 297, 485; 401/195; 40/452, 455

[56] References Cited

U.S. PATENT DOCUMENTS

| | | | |
|---|---|---|---|
| 1,640,414 | 8/1927 | Lake | 101/406 |
| 1,651,568 | 12/1927 | Willard | 101/406 |
| 2,312,727 | 3/1943 | Nisenson | 101/368 |
| 2,899,895 | 8/1959 | Tannery | 101/405 |
| 4,172,419 | 10/1979 | Munyon | 101/368 |
| 4,531,310 | 7/1985 | Acson et al. | 40/455 |
| 4,703,573 | 11/1987 | Montgomery et al. | 40/455 |
| 4,748,756 | 6/1988 | Ross | 40/455 |
| 4,936,780 | 6/1990 | Cogliano | 446/397 |
| 4,990,092 | 2/1991 | Cummings | 40/455 |
| 5,049,107 | 9/1991 | De Nittis | 446/397 |
| 5,066,011 | 11/1991 | Dykstra et al. | 446/485 |

FOREIGN PATENT DOCUMENTS

| | | | |
|---|---|---|---|
| 3505944 | 2/1985 | Fed. Rep. of Germany | 401/195 |
| 0255182 | 2/1990 | Japan | 101/114 |

*Primary Examiner*—Edgar S. Burr
*Assistant Examiner*—Anthony H. Nguyen
*Attorney, Agent, or Firm*—Dorr, Carson, Sloan & Peterson

[57] ABSTRACT

A rubber stamp is disclosed which produces a special effect when the stamp is pressed against a medium to be imprinted therewith. The special effects generated by the stamp can include audible (sound and/or music), light (patterns and/or sequences), and/or aromas. A cavity in the wood block of the rubber stamp contains the electronic circuitry necessary to provide the special effects messages. A sensor is affixed within the wood block, such as a pressure sensitive switch between the block and the rubber stamp, so as to trigger the electronic cicuitry to issue the special effects message simultaneously with the imprinting of a visual image from the rubber stamp upon the desired medium.

37 Claims, 4 Drawing Sheets

SPECIAL EFFECTS RUBBER STAMP

BACKGROUND OF THE INVENTION

1. Field of the Invention

The present invention relates to rubber stamps and, more particularly, rubber stamps capable of producing special effects such as those producing sound, light, and other special effects.

2. Statement of the Problem

Rubber stamps have been conventionally used for a long period of time to transfer an ink message onto paper sheets. A wide variety of rubber stamps are available which transfer ink images of animals, greetings, business information, or other types of objects. An entire marketplace has been established wherein retail stores carry a substantial variety of rubber stamps and rubber stamp accessories. To a large extent, modern rubber stamps are purchased for a business application, an entertainment value or as a toy and novelty item.

Most rubber stamps utilize a solid wood block which is crafted to be gripped by the hand of the user. The rubber stamp image is usually carved from rubber and then affixed to a foam pad which is then affixed to the bottom of the wood block. On the upper surface or a side surface of the wood block is typically placed a visual representation of the image that is being transferred by the rubber stamp.

A need exists to provide special effects to a conventional rubber stamp that enhances the business, entertainment, toy, or novelty value of a conventional rubber stamp. Such special effects would include, for example, audible messages such as sound or music, visual messages such as different colored lights or sequences of light patterns, aromas, or a combination of sound, light, and/or aromas.

Furthermore, a need exists for a rubber stamp with special effects that can be easily manufactured on a mass production basis.

3. Solution to the Problem

The present invention provides a solution to the above problem by providing a cavity in the wood block of the rubber stamp so as to contain the electronic circuitry necessary to provide the special effects messages. A sensor is affixed within the wood block, such as a pressure sensitive switch between the block and the rubber stamp, so as to trigger the electronic circuitry to issue the special effects message simultaneously with the imprinting of the visual image from the rubber stamp upon the desired medium.

The present invention provides a variety of special effects including audible (sound and/or music), light (patterns and/or sequences), and/or aromas. The message generating electronics of the present invention are contained within a cavity of the wood block so as not to interfere with the conventional operation or visual appearance of the conventional wood block rubber stamp.

Finally, the present invention can be quickly and easily assembled via mass production and is capable of being easily modified for different special effects.

SUMMARY OF THE INVENTION

The rubber stamp of the present invention produces a special effect when the stamp is pressed against a medium to be imprinted therewith. The special effects generated by the stamp can include audible (sound and/or music), light (patterns and/or sequences), and/or aromas. A cavity in the wood block of the rubber stamp contains the electronic circuitry necessary to provide the special effects messages. A sensor is affixed within the wood block, such as a pressure sensitive switch between the block and the rubber stamp, so as to trigger the electronic circuitry to issue the special effects message simultaneously with the imprinting of a visual image from the rubber stamp upon the desired medium.

DETAILED SPECIFICATION

Figure 1:
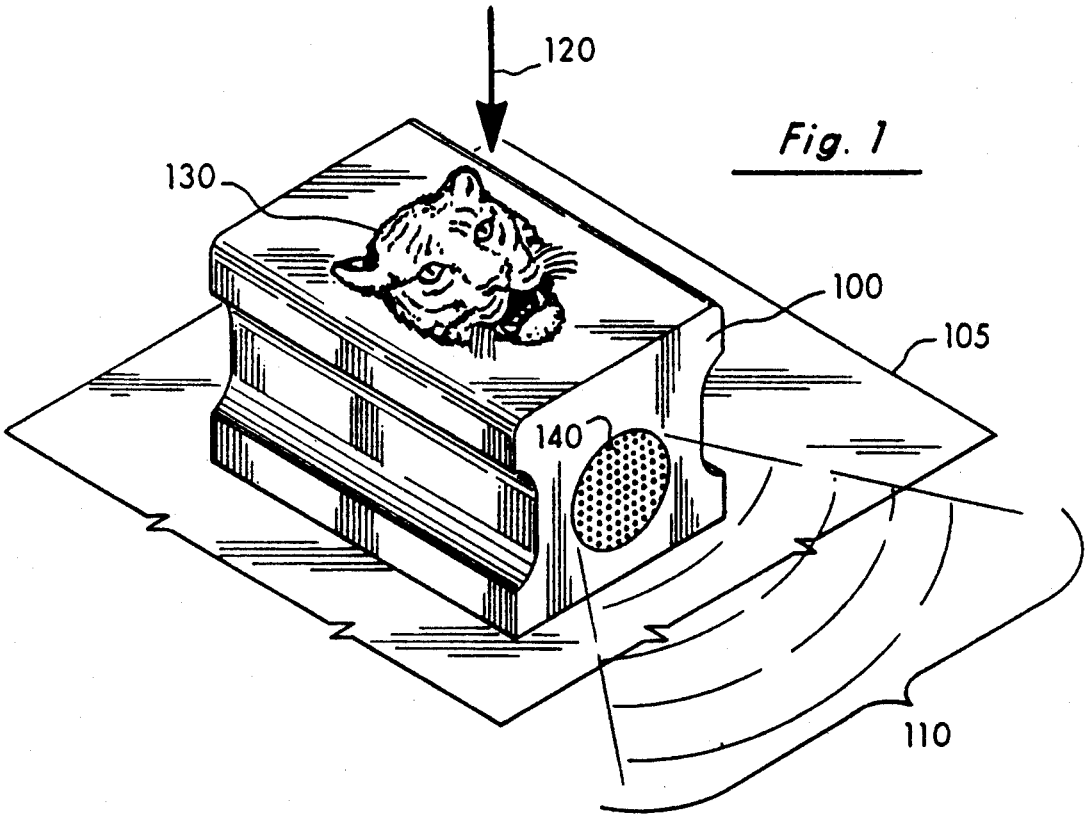
FIG. 1 is an illustration of the rubber stamp device of the present invention in operation, showing an audible message being generated concurrently with an imprinting of an image contained on the rubber stamp.
Figure 2:
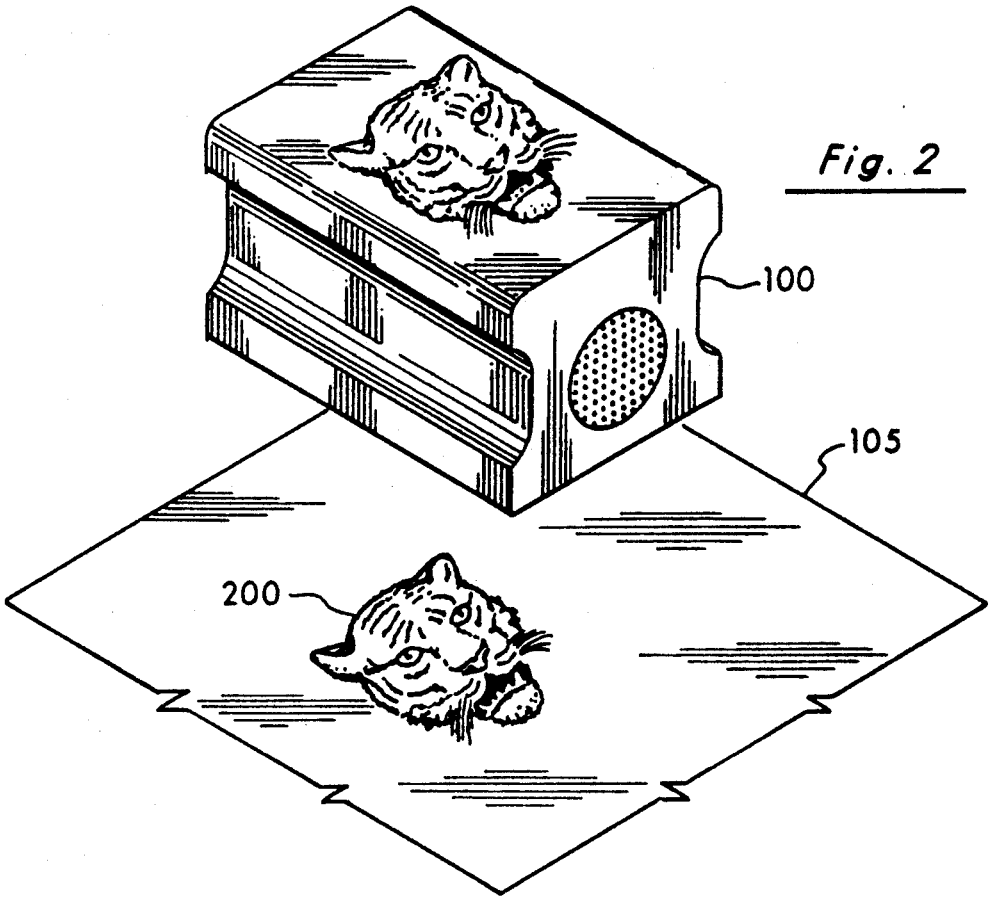
FIG. 2 shows the rubber stamp device and an imprinted image produced by operation of the device.

FIG. 1 illustrates the operation of the rubber stamp device 100 of the present invention, showing a special effects sound message 110 being generated when the rubber stamp device 100 is pressed against a medium, such as paper, to be imprinted 105. FIG. 2 shows the resulting imprinted visual image 200 on the medium 105. Typically, a reproduction 130 of the image printed by the stamp device 100 is affixed to the top of the stamp device 100. In the example of FIGS. 1 and 2, the sound 110 of a "roar" is produced upon imprinting. The sound 110 relates to the image 200. Other audible examples could be a pig-"oink," the word "rush," the sound of a jet, or a message such as "I love you." The message could also be lights or aromas.

1. Operation of the Rubber Stamp Device

Figure 3:
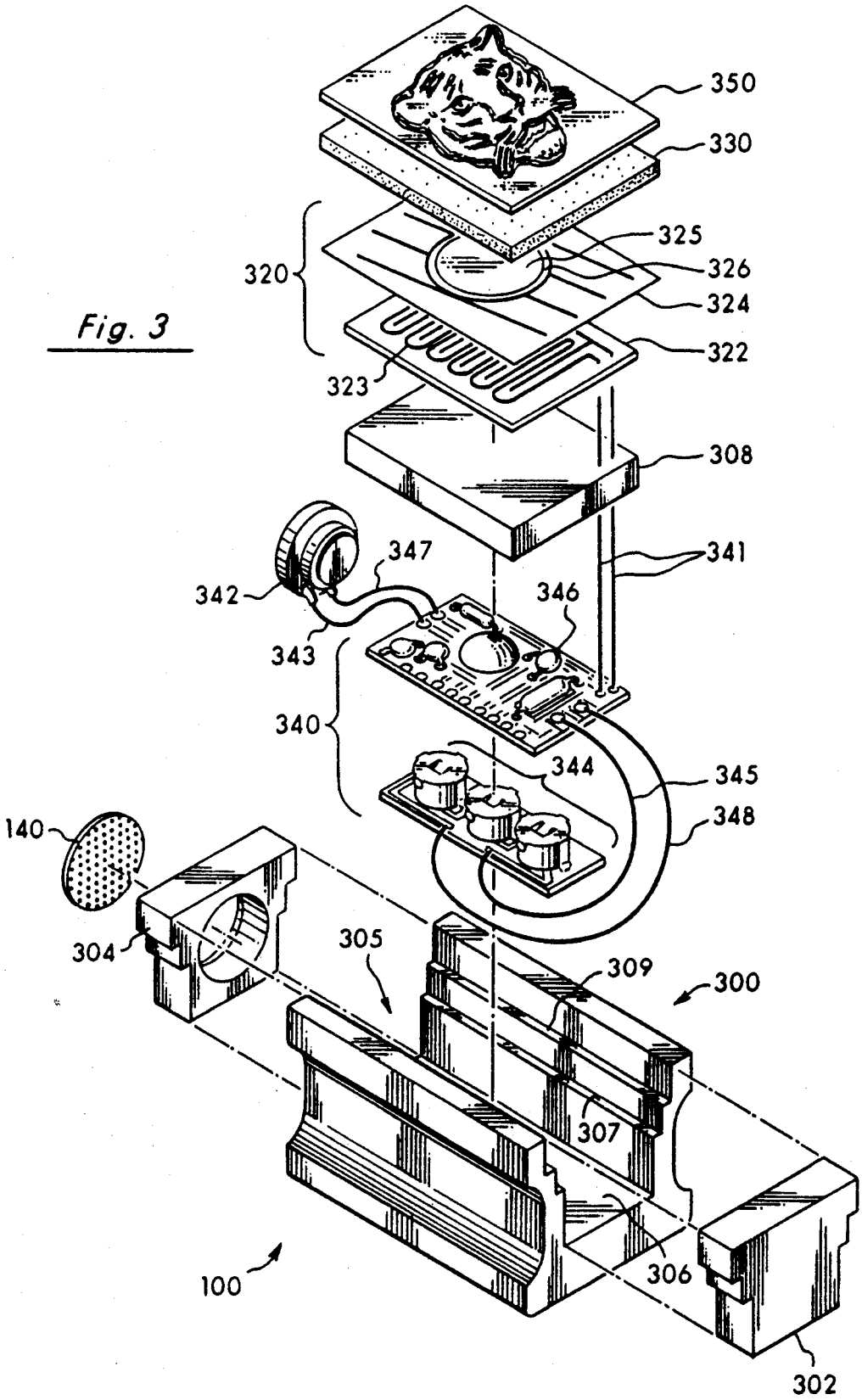
FIG. 3 is an exploded perspective view of the rubber stamp device.

FIG. 3 is an exploded perspective view of the rubber stamp device 100. In order to operate the rubber stamp device 100, the rubber stamp element 350 is typically pressed against an ink pad (not shown) and then pressed in direction 120 against the medium 105 to which the visual image 200 is to be transferred. Alternatively, the stamp element 350 can be self-inking, in which case, an ink pad is not required. It is to be expressly understood, however, that the method chosen for applying ink to the stamp element 350 is not a pertinent feature of the present invention. When the rubber stamp element 350 is pressed against the medium 105, an ink image is transferred to the medium 105, and the special effect message 110 is generated. The present invention is capable of providing a variety of special effects 110 including audible effects (sound and/or music), light (patterns and/or sequences), and/or aromas, although typically only one effect is produced by a given stamp device 100.

2. Pressure-Sensitive Switch Mechanism

The special effect message 110 is produced in response to the creation of the image 200. For example, the message 110 could be produced in response to a predetermined amount of pressure that is applied to a momentary contact, thin film pressure-sensitive switch 320 as a result of the rubber stamp element 350 being pressed against the medium 105.

In the preferred embodiment, as shown in FIG. 3, A pressure-sensitive switch 320 (shown in FIG. 3) of the type used in the rubber stamp device 100 consists of, for example, a contact wafer 322 and a bridge wafer 324 separated by a thin strip of compressible insulating material 326. The contact wafer 322 typically has a printed circuit contact element 323 comprised of two closely-spaced conductors disposed essentially parallel to one another in a serpentine pattern on the surface of the contact wafer 322. The bridge wafer 324 contains an electrically-conductive bridge element 325 which, when pressed against the contact element 323, causes the switch 320 to "close," i.e., the bridge element 325 allows current to flow between the two conductors of the contact element 323. The bridge wafer 324 shown is typically made of mylar or acetate with the bridge element 325 consisting of an electrically conductive thin film carbonized area located on the bottom of the bridge wafer 324.

Note that the bridge element 325 and the thin strip of compressible insulating material 326 are visible (from above) in the drawing due the fact that the mylar bridge wafer 324 is transparent. The thin strip of compressible insulating material 326 normally separates the bridge element 325 from the contact element 323 so that the switch 320 is in a normally open position. However, when pressure is applied to the bridge wafer 324, such as when the rubber stamp device 100 is pressed against a medium 105, the thin strip of compressible insulating material 326 is compressed to allow the bridge element 325 to short across the two conductors of the contact element 323, thus "closing" the switch 320 and activating the electronics of the message circuit 340.

While a preferred embodiment for a pressure-sensitive switch is shown, it is to be expressly understood that any of a number of different switch designs could be utilized under the teachings of the present invention, For example, an accellerometer could be used to sense the force of impact of the rubber stamp 100.

3. The Message Circuit

Figure 5:
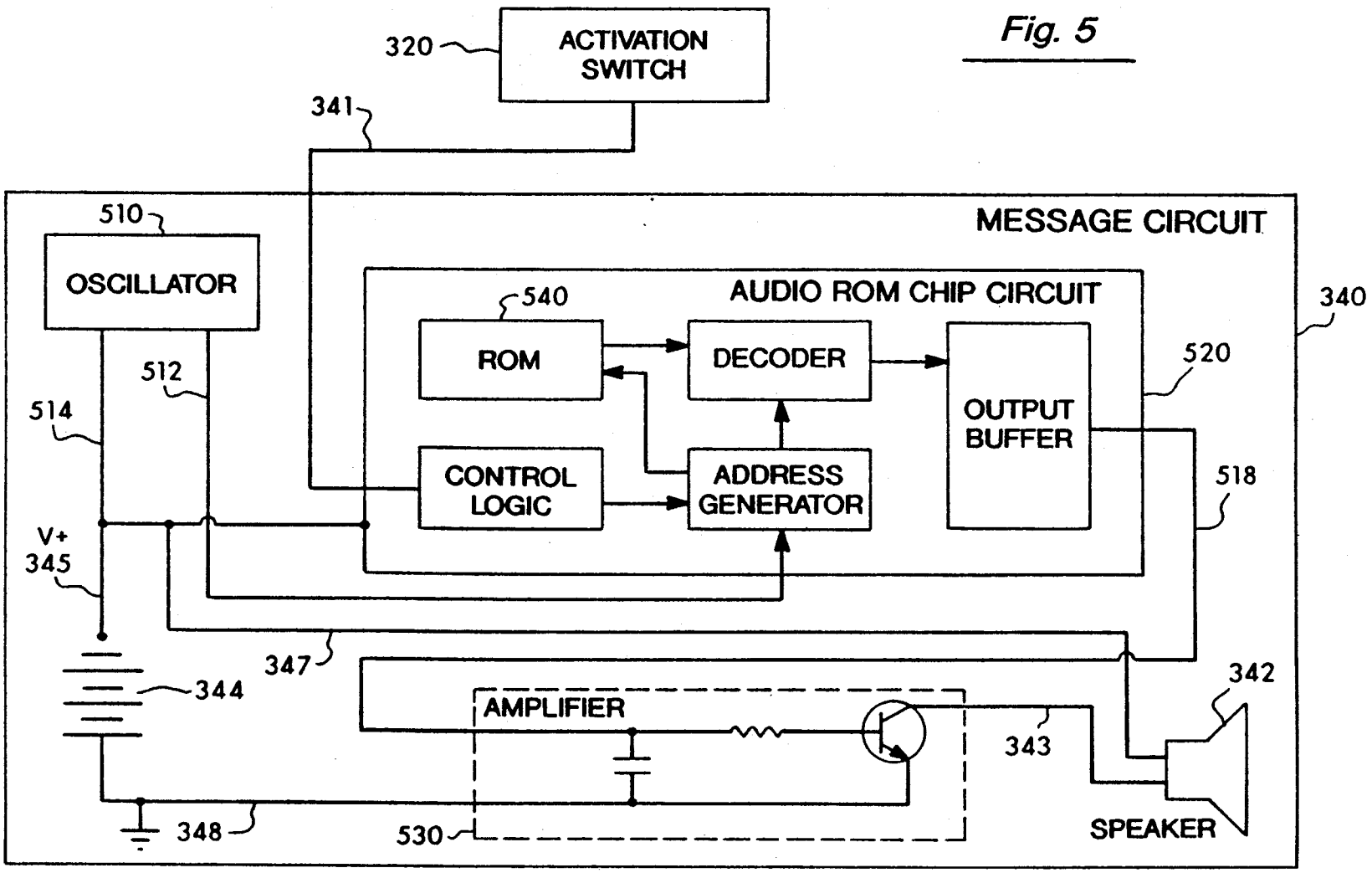
FIG. 5 is a block diagram of the message circuit used to generate an audible message.

FIG. 5 is a block diagram showing an embodiment of the present invention using an electronic circuit 340 to generate an audible message 110. The normally open momentary contact switch 320 is connected to the message circuit 340 via leads 341 which pass through the bottom cover 308 of the stamp device 100. The message circuit 340 is typically powered by a 3 to 5 volt battery 344, which is connected to message circuit board 346 via wires 345 and 348. In one embodiment of the present invention, the battery 344 remains permanently connected in the message circuit 340, with the battery also being permanently installed in the rubber stamp device 100. In an alternative embodiment, a power switch (not shown) can be connected between the battery 344 and the message circuit 340 components, and the battery can be removable through a hatch on endplate 302. Providing a power switch would allow the rubber stamp device 100 to be used without producing the special effect(s). When the switch 320 is closed, the audio ROM chip circuit 520 is activated. The audio ROM chip circuit 520 has sound effects digitally stored in mask ROM 540 which simulate, for example, a human voice, or an animal, or which may be indicative of other sounds. Other sound effects which may be stored in mask ROM 540 include music, such as that stored in a Nippon Precision Circuits NPC M1130 mask ROM which provides for several minutes of simultaneous dual-note music, for example, Christmas carols. The audio ROM chip circuit 520 is typically a Mosel MSS0281 integrated circuit, which is connected to a mask ROM 540 containing a digital representation of the audio special effects message. The mask ROM 540 is typically ADPCM (adaptive pulse code modulation) encoded, but other conventional A/D (analog/digital) encoding techniques may be used. The audio ROM chip circuit 520 works in conjunction with a free-running oscillator 510 to decode and output, on lead 518, a sequence of audio signals, the digital representation of which have been stored in the mask ROM 540. The oscillator 510 is well-known in the art, and is typically a ceramic type oscillator which typically generates a frequency in the range of 400 killohertz to 1 megahertz. The oscillator 510 two output leads, the first of which 512 is connected to the voice ROM chip 520. Mask ROM 540 and the oscillator 510 may be either a part of, or separate from, the voice ROM chip 520. The audio signals output from the voice ROM chip 520 pass through an optional audio amplifier 530 and are applied to a speaker 342 via a first speaker lead 343, so as to be made audible. The speaker 342 also has a second lead 347 which is connected to V+ (lead 345) of the battery 344.

Figure 6:
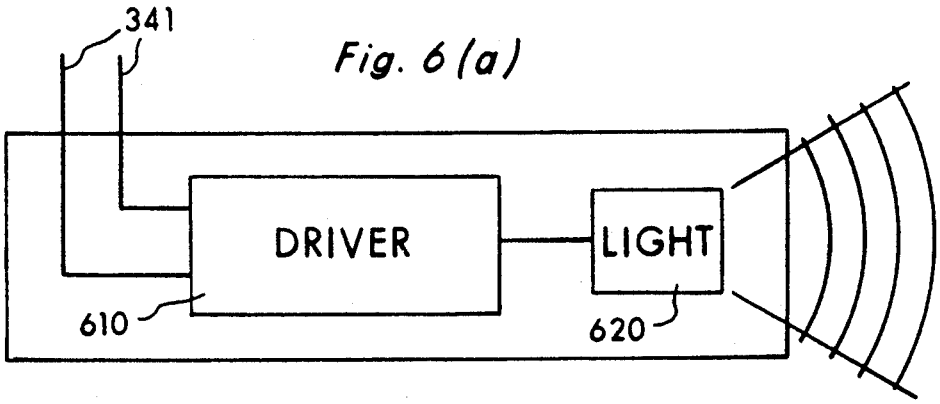
FIGS. 6(*a*) and 6(*b*) show, in block diagram form, two alternative embodiments of the rubber stamp device.
Figure 6:
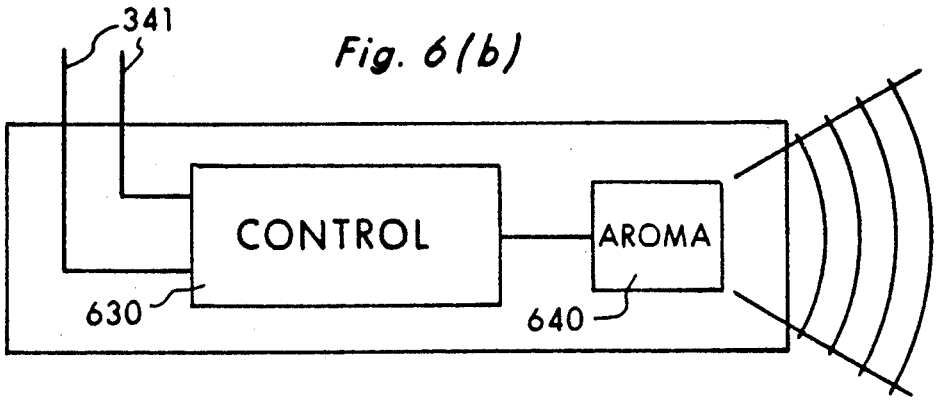

It is to be expressly understood that the actual circuitry 340 utilized under the teachings of the present invention could be designed using different circuit components and schematics. FIGS. 6(*a*) and 6(*b*) show alternative embodiments of the rubber stamp device of the present invention. In a first alternative embodiment, a driver 610, responsive to the pressure-sensitive switch 320, actuates a visual display 620, such as a liquid crystal display showing a visual or textual message. The visual display 620 could also be comprised of light-emitting diodes ("LED"s) or one or more conventional incandescent light sources, representing, for example, to a pair of "eyes" corresponding to the eyes of an animal image imprinted by the rubber stamp device 100.

In a second alternative embodiment, a control unit 630, responsive to the pressure-sensitive switch 320, actuates an aroma-releasing element 640. The aroma-releasing element 640 can be a pressurized aroma-containing substance, or a thermally activated chemical, or the like.

The message circuit 340 of the present invention is not to be limited by the actual circuit design of FIGS. 5 and 6. The message circuit functions to transmit a message in response to the transference of the image 200 to the medium 105.

4. Construction of the Rubber Stamp Device

In the preferred embodiment, the rubber stamp device 100 is constructed form wood, because wood is the material of preference in the market for quality stamps. The present invention is designed to be easily and inexpensively manufactured in large quantities using wood for the stamp body 300.

Figure 4:
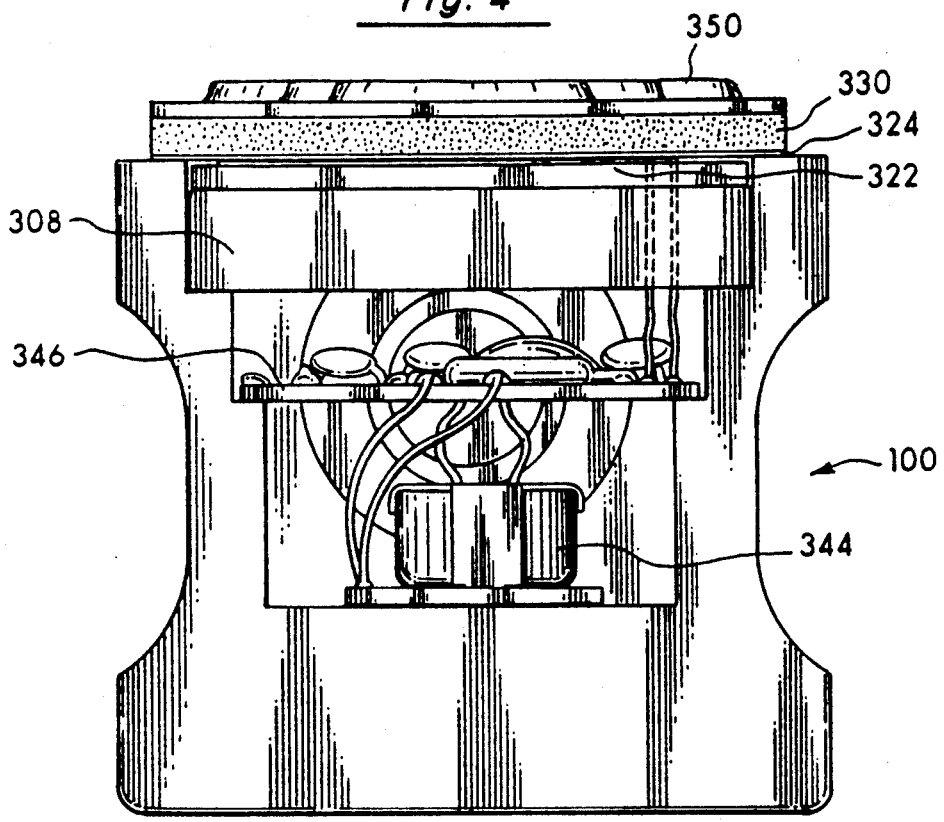
FIG. 4 is a cross-sectional end view showing the placement of the internal components of the rubber stamp device.

As shown in FIGS. 3 and 4, a channel 305 in the wood block housing 300 of the rubber stamp device 100 contains the electronic circuit 340 necessary to provide the special effects messages 110. A sensor 320 is affixed to the bottom cover 308 of the wood block housing 300, such as a pressure sensitive switch 320 affixed between the outside surface of the bottom housing cover 308 and the rubber stamp element 350. The bottom housing cover is rigid in order to provide a rigid base for operation of the rubber stamp element 350. In a typical rubber stamp device 100, a foam rubber pad 330 is glued between the rubber stamp element 350 and the switch 320. When sufficient pressure is applied to the rubber stamp element 350, the electronic circuitry 340 is activated to issue a special effects message essentially simultaneously with the imprinting of a visual image 200 from the rubber stamp element 350 upon the desired medium. The electronic circuitry 340 is typically comprised of a battery 344 and a message circuit board 346, which is connected to a speaker 342. One end of the wood block housing 300 has an endplate 304 containing an aperture in which a speaker protection element 140 is located, behind which the speaker 342 is mounted. The other end of the housing 300 has a solid, non-perforated endplate 302. As best seen from FIG. 3, endplate 302 and endplate 304 are cut to conform to the cross-sectional shape of the channel 305 in the wood block housing 300.

While a preferred construction for a wooden block is detailed in FIGS. 3 and 4, it is to be expressly understood that a variety of other constructions could be utilized. For example, the cavity 305 could be simply routed out of a single piece of wood.

5. Process for Manufacturing the Rubber Stamp Device

It is important to inexpensively manufacture wooden rubber stamps containing the special effects of the present invention on a large scale basis. The following process provides one novel approach for manufacturing the rubber stamp device 100.

Step (a)—The wood block housing 300 of the rubber stamp device 100 has a channel 305 which is typically cut from an elongated solid wood board (not shown) in a direction along the length of the board, using a dado-type blade. The solid wood board has a length which is a multiple of the length of a given wood block 300 housing. In one embodiment of the present invention, the channel 305 is cut so as to provide a ceiling 306, a first ledge 307, and a second ledge 309.

Step (b)—The channeled board is then cut, at a 90 degree angle to the length thereof, into a plurality of housings 300, each of which is then made into a housing 300 for the rubber stamp device 100.

Step (c)—For each housing 300, a pair of endplates 302,304 are cut from wood so as to snugly fit into the housing 300, thereby obviating the need for a jig to hold the endplates 302,304 in place while being glued. In order to make the endplates 302,304, a plurality of grooves are cut in an elongated board, the grooves being cut in a direction parallel to the longitudinal dimension of the second board so as to form a grooved board having a cross-sectional size and shape identical to a cross-section of the channel in the housing 300.

Step (d)—The grooved board is then cut, at a 90 degree angle to the length thereof, into a plurality of endplates 302,304.

This technique of channeling solid boards into a multiplicity of housings 300 and endplates 302,304 is both a high-speed and a low-cost manufacturing technique.

Step (e)—A board having cross-sectional dimensions equal to the desired size of the housing cover 308 is cut, at a 90 degree angle to the length thereof, into a plurality of housing covers 308.

Step (f)—A hole is drilled in the housing cover 308 to accommodate the wires 341 from the switch 320.

Step (g)—The endplates 304 and 302 are then glued into the ends of the housing 300 such that the outer portions thereof are flush with the outside of the housing 300.

Step (h)—When the glue has set up, a hole is drilled in endplate 304.

Step (i)—The speaker protection element 140 and the speaker 342 are then installed in the drilled hole. The battery 348 is mounted on the ceiling 306 of the housing 300, and the message circuit board 346 is mounted on the first ledge 307. The two switch connection wires 341 from the contact wafer 322 are passed through the hole in the bottom housing cover 308.

Step (j)—The housing cover 308 is then glued into place on the second ledge 309 so that the outer surface of the cover 308 is slightly recessed with respect to the outside of the housing 300. This recess has a depth equal to that of the thickness of the contact wafer 322 so as to allow the contact wafer 322, to be mounted flushly with the bottom of the housing 300.

Step (k)—The contact wafer 322 of the pressure sensitive switch 320 is glued to the outside of the bottom housing cover 308, and the bridge wafer 324 is then glued to the contact wafer and to the bottom of the housing 300, since the bridge wafer 324 is typically larger than the contact wafer 322 and thus overlaps onto the housing 300.

Step (l)—The foam rubber pad 330 is then glued to the other side of the switch 320.

Step (m)—Finally, the rubber stamp element 350 is then glued to the foam rubber pad 330.

The above sets forth a specific manufacturing process and is not meant to limit the overall teachings of the invention. Furthermore, variations to the above method of manufacturing could be made without departing from the scope of coverage of the claimed method.

While a specific embodiment of the present invention has been disclosed, it is expected that those skilled in the art can and will devise variations of the present invention which nevertheless fall within the scope of the appended claims.

I claim:

1. An image transfer device capable of generating an imprinted reproduction of an image to a target object comprising:

a housing having a formed interior region and a bottom, means affixed to said bottom of said housing for transferring said reproduction of said image to said target object upon contact with said target object;

means, disposed substantially within said formed interior of said housing, operative upon said contact between said transferring means and said target object, for generating at least one non-imprinted message in response to said transfer of said image to said target object, said at least one non-imprinted message specifically associated with said image, means in said generating means and in said formed interior for storing said at least one non-imparted message.

2. The device of claim 1 wherein said image transferring means is an ink stamp.

3. The device of claim 1, wherein said at least one non-imprinted message is generated at a time substantially occurring to when said contact is effected with a predetermined amount of force.

4. The image transfer device of claim 1 wherein said housing is formed from wood.

5. The device of claim 1, wherein said generating means includes a pressure-sensitive switch responsive to said contact, said switch comprising a pair of contact elements and a bridge element, said bridge element providing an electrically conductive path between said contact elements when said contact with said target object is effected with a predetermined amount of force.

6. The device of claim 1, wherein said generating means comprises means for providing a visual indication.

7. The device of claim 1, wherein said generating means comprises a plurality of light emitting elements.

8. The device of claim 1, wherein said generating means comprises means for producing an audible sound corresponding to said message.

9. The device of claim 1, wherein said at least one non-imprinted message comprises a sound.

10. The device of claim 1, wherein said at least one non-imprinted message comprises an aroma.

11. The image transfer device of claim 1 further comprising means connected to said generating means for selectively inhibiting the operation of said generating means.

12. The image transfer device of claim 1 wherein said transferring means is constructed from rubber.

13. A device for transferring a visual image to a surface of a target object, said device comprising:

a housing having a formed interior region and a bottom;

means, affixed to said bottom of said housing, for transferring said visual image to said surface of said target object upon contact with said target object; and means, disposed substantially within said formed interior of said housing, operative upon said contact between said transferring means and said target object, for generating an audible message in response to said transfer of said image to said target object, said audible message specifically associated with said image, a memory in said generating means and in said formed interior for storing said audible message in digital form.

14. The device of claim 13, further comprising:

means, responsive to said generating means, for producing a visual message.

15. The device of claim 13 wherein said generating means includes a pressure-sensitive thin film switch responsive to said contact, said switch comprising a pair of contact elements and a bridge element, said bridge element providing a conductive electrical path between said contact elements when said contact with said target object is effected with a predetermined amount of force.

16. The device of claim 13, wherein said audible message is produced at a time substantially occurring to when said contact is effected with a predetermined amount of force.

17. The device of claim 13 wherein said housing is formed from wood.

18. The device of claim 13 further comprising means connected to said generating means for selectively inhibiting the operation of said generating means.

19. The device of claim 13 wherein said transferring means is constructed from rubber.

20. A rubber stamp device, said rubber stamp device having a reverse image formed thereon for transference of said image to an object, said rubber stamp device comprising:

a housing having a formed interior region and a bottom, said reverse image being disposed on said bottom of said housing;

means, disposed within said formed interior region, operative upon said contact between said stamp and said object, for generating an audible message in response to said transfer of said image to said object, said audible message specifically associated with said image;

a memory in said generating means and in said formed interior for storing said audible message in digital form;

a pressure-sensitive thin film switch, disposed between said bottom of said housing and said formed reverse image, for initiating said generation of said audible message, said switch being responsive to said contact between said stamp and said object.

21. The apparatus of claim 20, wherein said audible message is produced at a time substantially occurring to when said contact is effected with a predetermined amount of force.

22. The rubber stamp device of claim 20 wherein said reverse image is formed from rubber.

23. The apparatus of claim 20, wherein said audible message generating means further comprises:

means, connected to said memory, for converting said digital form of said stored audible message to a control signal; and means, responsive to said contact, for initiating said generation of said predetermined audible message.

24. The rubber stamp device of claim 20 wherein said housing is formed from wood.

25. The rubber stamp device of claim 20 further comprising means connected to said generating means for selectively inhibiting the operation of said generating means.

26. A method of manufacturing a rubber stamp comprising the steps of:

cutting a channel in a first wooden board, said first board having a longitudinal dimension, a height, and a width, said longitudinal dimension of said first board being significantly greater than both said height and said width, said channel being cut in a direction parallel to said longitudinal dimension of said first board;

cutting a plurality of grooves in a second board, said second board having a longitudinal dimension, said grooves being cut in a direction parallel to said longitudinal dimension of said second board so as to form a grooved board having a cross-sectional size and shape identical to a cross-section of said channel in said first board;

cutting said first board into a plurality of stamp housings, each said stamp housing being cut at a 90 degree angle with respect to said longitudinal dimension of said first board, each said stamp housing having a first side, a second side, and a bottom, said first side and said second side each having a first end, a second end, and a bottom edge;

cutting said grooved board into a plurality of endplates, each said endplate being cut at a 90 degree angle with respect to said longitudinal dimension of said grooved board; and for each said stamp housing:

affixing, between said first side and said second side of said stamp housing, at said first end thereof, a first one of said plurality of endplates;

affixing, between said first side and said second side of said stamp housing, at said second end thereof, a second one of said plurality of endplates, thereby forming an interior region in said stamp housing;

affixing, into said interior region of said stamp housing, a circuit for generating a message;

affixing, between said bottom edge of said first side and said bottom edge of said second side of said stamp housing, a stamp housing bottom; and affixing a rubber ink stamping element to said stamp housing bottom.

27. The method of claim 26, including the additional steps of:

drilling, in said first one of said endplates, and into a portion of said housing, a hole;

mounting said speaker in said hole; and before performing the step of affixing the ink stamping element:

affixing a pressure-sensitive switch to said stamp housing bottom; and affixing a foam pad to said switch; and affixing said ink stamping element to said foam pad instead of to said stamp housing bottom.

28. A rubber stamp, said rubber stamp having a reverse image formed thereon for transference of an image corresponding to said reverse image to an object, said rubber stamp comprising:

a housing having a rubber stamp element on the bottom surface thereof carrying said reverse image, means on said rubber stamp for generating at least one special effect said at least one special effect specifically associated with said image, said housing having a formed interior region containing said generating means, and, means in said generating means and in said formed interior for storing said at least one special effect.

29. The rubber stamp of claim 28 wherein said housing is formed from wood.

30. The rubber stamp of claim 28 further comprising means responsive to said image transference for activating said generating means.

31. The rubber stamp of claim 28 further comprising means located between said bottom of said housing and said rubber stamp element for activating said generating means in response to said image transference.

32. The rubber stamp of claim 28 wherein said at least one special effect is sound.

33. The rubber stamp of claim 28 wherein said at least one special effect is light.

34. The rubber stamp of claim 28 wherein said at least one special effect is an aroma.

35. The rubber stamp of claim 28 further comprising means connected to said generating means for selectively deactivating said generating means.

36. A rubber stamp, said rubber stamp having a reverse image formed thereon for transference of an image corresponding to said reverse image to an object, said rubber stamp comprising:

a rubber stamp element carrying said reverse image, means on said rubber stamp for generating at least one special effect, said at least one special effect specifically associated with said image, a memory in said generating means for storing said at least one special effect in digital form, a housing having said rubber stamp element placed on the bottom surface thereof, means connected to said generating means and located between said bottom of said housing and said rubber stamp element for activating said generating means in response to said image transference.

37. A rubber stamp, said rubber stamp having a reverse image formed thereon for transference of an image corresponding to said reverse image to an object, said rubber stamp comprising:

a rubber stamp element carrying said reverse image, means on said rubber stamp for generating at least one special effect, said at least one special effect specifically associated with said image, a housing having said rubber stamp element placed on the bottom surface thereof, said housing having a formed interior substantially containing said generating means, a memory in said generating means and in said formed interior for storing said at least one special effect in digital form, and means connected to said generating means for activating said generating means in response to said image transference.

* * * * *